US005563600A

United States Patent [19]

Miyake

[11] Patent Number: 5,563,600

[45] Date of Patent: Oct. 8, 1996

[54] DATA TRANSMISSION FOR REMOTE-CONTROLLED SECURITY SYSTEM

[75] Inventor: Takashi Miyake, Iwak, Japan

[73] Assignee: Alpine Electronics, Inc., Tokyo, Japan

[21] Appl. No.: 263,846

[22] Filed: Jun. 22, 1994

[30] Foreign Application Priority Data

Jun. 30, 1993 [JP] Japan ..... 5-187056

[51] Int. Cl.[6] ..... G08C 19/12

[52] U.S. Cl. ..... 341/173; 341/176; 341/178; 340/825.34; 340/825.30

[58] Field of Search ..... 341/173, 176, 341/178; 340/825.69, 825.56, 825.57, 825.62, 825.72, 825.34, 825.30

[56] References Cited

U.S. PATENT DOCUMENTS

| | | | |
|---|---|---|---|
| 4,595,985 | 6/1986 | Bongard et al. | 340/825.69 |
| 4,743,898 | 5/1988 | Imedio | 340/825.34 |
| 4,847,614 | 7/1989 | Keller | 340/825.56 |
| 4,988,992 | 1/1991 | Heitschel et al. | 341/176 |
| 5,272,752 | 12/1993 | Myers et al. | 340/825.34 |
| 5,363,448 | 11/1994 | Koopman, Jr. et al. | 340/825.34 |
| 5,442,341 | 8/1995 | Lambropoulos | 340/825.34 |

*Primary Examiner*—Jeffery Hofsass
*Assistant Examiner*—Ashok Mannava
*Attorney, Agent, or Firm*—Guy W. Shoup; Norman R. Klivans; Patrick T. Bever

[57] ABSTRACT

A remote-controlled apparatus improves the reliability of a vehicle security system. Each time the transmitting unit transmits data, a first code updating section changes a variable code storage in a memory in the transmitting unit by predetermined shift processing to form a new variable code, and replaces the preceding variable code with the new variable code. An ID code setting section sets an ID code formed of the variable code and a fixed code. Predetermined data including the ID code and command signals is transmitted. When the receiving unit receives the predetermined data, the fixed code and the variable code in the received ID code are compared with a fixed code and a variable code stored in the receiving unit. If it is thereby determined that the fixed codes and predetermined portions of the variable codes coincide with each other, a predetermined security operation is started or stopped according to the content (command signals) of the received data, and a code updating section in the receiving unit changes the received variable code by predetermined shift processing to form a new variable code, and replaces the preceding stored variable code in the receiving unit with the new code.

21 Claims, 6 Drawing Sheets

FIG. 3

| TRANSMISSION TIMES | VARIABLE CODE OF TRANSMITTING UNIT 1 |
|---|---|
| 1 ST TIME | 1 0 1 1 0 0 0 1 |
| 2ND TIME | 0 1 0 1 1 0 0 0 |
| 3RD TIME | 1 0 1 0 1 1 0 0 |
| 4TH TIME | 1 1 0 1 0 1 1 0 |
| 5TH TIME | 0 1 1 0 1 0 1 1 |
| 6TH TIME | 0 0 1 1 0 1 0 1 |
| 7TH TIME | 1 0 0 1 1 0 1 0 |
| 8TH TIME | 0 1 0 0 1 1 0 1 |

FIG. 5

| TRANSMISSION TIMES | VARIABLE CODE OF TRANSMITTING UNIT 1 | | ACCEPTABLE CODES OF SECURITY RECEIVING UNIT | |
|---|---|---|---|---|
| | FIXED CODE | VARIABLE CODE | FIXED CODE | VARIABLE CODE |
| 1 | 10101010 | 10110001 | 10101010 | ********<br>10110001 |
| 2 | 10101010 | 01011000 | 10101010 | *1011000<br>01011000 |
| 3 | 10101010 | 10101100 | 10101010 | *0101100<br>10101100 |
| 4 | 10101010 | 11010110 | 10101010 | *1010110 |
| 5 | 10101010 | 01101011 | 10101010 | *1010110 |
| 6 | 10101010 | 10110101 | 10101010 | *1010110 |
| 7 | 10101010 | 01011010 | 10101010 | *1010110<br>01011010 |
| 8 | 10101010 | 00101101 | 10101010 | *0101101<br>00101101 |
| | | | | *0010110 |

DATA TRANSMISSION FOR REMOTE-CONTROLLED SECURITY SYSTEM

BACKGROUND OF THE INVENTION

1. Field of the Invention

This invention relates to a remote-controlled automatic control apparatus, such as a security apparatus or a keyless entry apparatus for a vehicle, and a data transmission method for the apparatus. More particularly, the present invention relates to a remote-controlled automatic control apparatus and a data transmission method for preventing a breach of security of the apparatus using a copying device such as a learning remote controller.

1. Description of the Related Art

A security system for protecting a motor vehicle and using a remote-control unit are known. Such a security system prevents burglary or theft by sounding a siren and/or turning on and off the head lamps of the vehicle as well as inhibiting the vehicle from being started and driven by starter cutting (for inhibition of engine starting) or fuel supply interruption, if a person other than the owner or user of the vehicle opens a door of the vehicle, or makes a certain impact on the vehicle, or opens the trunk, when the security system is armed.

Such security systems include a type using a portable transmitting unit (remote control unit) for starting and stopping the security operation. Starting the security operation (arming) or stopping the security operation (disarming) is effected by pressing an arming key or disarming key provided on the transmitting unit.

In such a security system, data transmitted from the transmitting unit has a predetermined identification (ID) code and can only arm or disarm a motor vehicle provided with a main security unit having the same ID code. Accordingly, one main unit cannot be armed or disarmed by a transmitting unit whose ID code is different from the ID code provided in the main unit. Thus the security system is arranged to have a special motor vehicle burglarproof function.

In this conventional security system, however, the ID code included in the data transmitted from the transmitting unit is fixed. Therefore, it is possible to prepare a transmitting unit falsely identifiable as the genuine transmitting unit by using a "copying machine" (such as a "learning" remote controller) to copy data transmitted from the genuine transmitting unit. The possibility of such wrongful copying reduces the effectiveness of the security system.

SUMMARY OF THE INVENTION

In view of these circumstances, the present invention provides a remote-controlled automatic control apparatus ensuring security against use of a transmitting unit prepared by such wrongful copying.

To achieve this, according to the present invention, a remote-controlled automatic control apparatus includes a transmitting unit and a receiving unit, predetermined data being transmitted from the transmitting unit to the receiving unit, each of the transmitting unit and the receiving unit having a storage section (memory) for storing a fixed code and a variable code. The transmitting unit includes a first code updating section for shifting the variable code stored in the storage section by a predetermined shift value, adding a predetermined code to the shifted variable code according to a transmission timing to form a new variable code, and replacing the preceding variable code with the new variable code each time data is transmitted, an ID code setting section for setting an ID code containing the variable code and the fixed code stored in the storage section, and a data transmitting section for transmitting predetermined data including the ID code set by the ID code setting section to the receiving unit.

The receiving unit includes a data receiving section for receiving the predetermined data from the transmitting unit, a code comparison and determination section for determining the fixed code and the variable code in the ID code in the received data by comparison with the fixed code and the variable code stored in the storage section, an operation control section for starting or stopping a predetermined operation according to a content of the received data when the fixed codes and predetermined portions of the variable codes coincide with each other as a result of the comparison and the determination made by the code comparison and determination section, and a second code updating section for shifting the received variable code by the predetermined shift value, adding a predetermined code to the shifted variable code to form a new variable code, and replacing the preceding variable code with the new variable code, when the fixed codes and the predetermined portions of the variable codes coincide with each other.

Also, in the second code updating section, when the fixed codes coincide with each other while the predetermined portions of the variable codes do not coincide with each other, the received variable code is shifted by the predetermined shift value, a predetermined code is added to the shifted code to form a new code, and the preceding variable code is replaced with the new variable code.

In the transmitting unit, each time data is transmitted, the variable code stored in the storage section is shifted by a predetermined shift value, a predetermined code is added to the shifted variable code according to a transmission timing to form a new variable code, and the preceding variable code is replaced with the new variable code. An ID code formed of the variable code and the fixed code stored in the storage section is set in the storage section, and predetermined data including the set ID code is transmitted to the receiving unit.

In the receiving unit, when the predetermined data from the transmitting unit is received, the fixed code and the variable code in the ID code in the received data are compared with the variable code and the fixed code stored in the storage section, and a predetermined operation is started or stopped according to a content of the received data if it is determined by this comparison that the fixed codes and predetermined portions of the variable codes coincide with each other. Also, the received variable code is shifted by the predetermined shift value, a predetermined code is added to the shifted bits to form a new variable code, and the preceding code is replaced with the new variable code. Accordingly, data is acceptable when the fixed codes and the variable codes coincide with each other. It is therefore impossible to make a transmitting unit identifiable as the genuine transmitting unit even by using a copying device such as a learning remote controller to copy the transmitted data.

Also, if the fixed codes coincide with each other while the predetermined portions of the variable code do not coincide with each other, the received variable code is shifted by the predetermined shift value, a predetermined code is added to the shifted bits to form a new variable code, and the preceding code is replaced with the new variable code.

Therefore, if normal transmitted data is next received, it can be accepted. The occurrence of ineffective key pressing on the transmitting unit is thereby limited.

BRIEF DESCRIPTION OF THE DRAWINGS

FIG. 3 is a diagram showing an example of setting a variable code in the transmitting unit;

FIG. 5 is a diagram showing setting an ID code in the security system in accordance with the present invention.

DESCRIPTION OF THE PREFERRED EMBODIMENT

Figure 1:
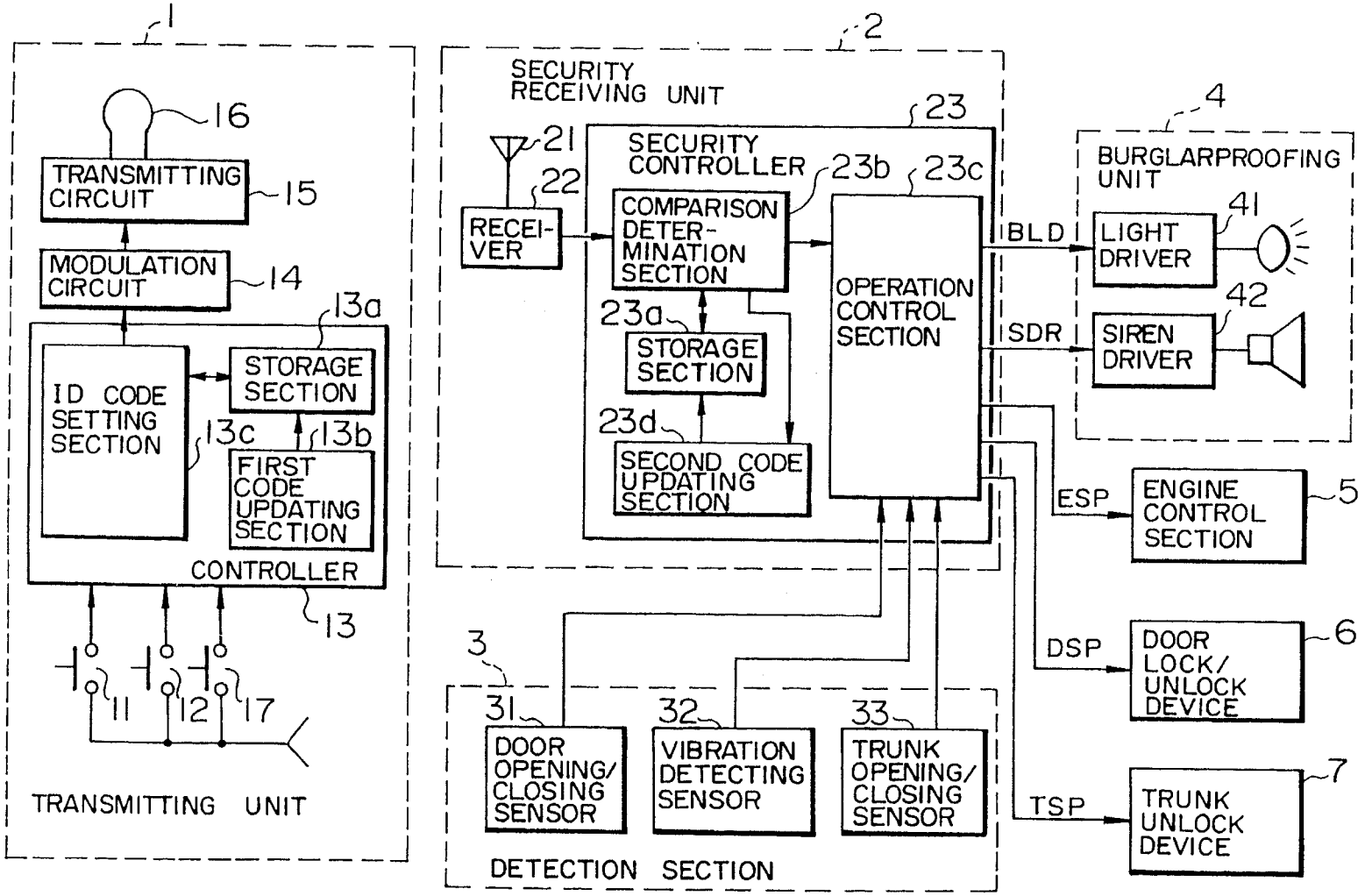
FIG. 1 is a block diagram of an embodiment of a security system in accordance with the present invention.

FIG. 1 is a block diagram of an embodiment of a vehicle security system in accordance with the present invention. A portable transmitting unit (remote controller unit) 1 transmits an arming command signal, a disarming command signal and a trunk unlock command signal to a security receiving unit mounted on the vehicle, by key pressing operations. The transmitting unit 1 has an arming key 11, a disarming key 12 and a trunk unlock key 17.

A controller 13 of the transmitting unit 1 includes a storage section (memory) 13*a* in which a fixed code and a variable code are previously stored, a first code updating section 13*b* which shifts the variable code stored in the storage section 13*a* by a predetermined shift value each time the arming key 11, the disarming key 12 or the trunk key 17 are pressed, and which thereafter adds a predetermined code to the shifted variable code to form a new variable code according to a transmitting time and replaces the preceding variable code with the new variable code, and an ID code setting section 13*c* for setting an ID code consisting of the fixed code and the variable code stored in the storage section 13*a*. The transmitting unit generates and outputs predetermined data including the ID code according to the operation of each key.

Figure 2:
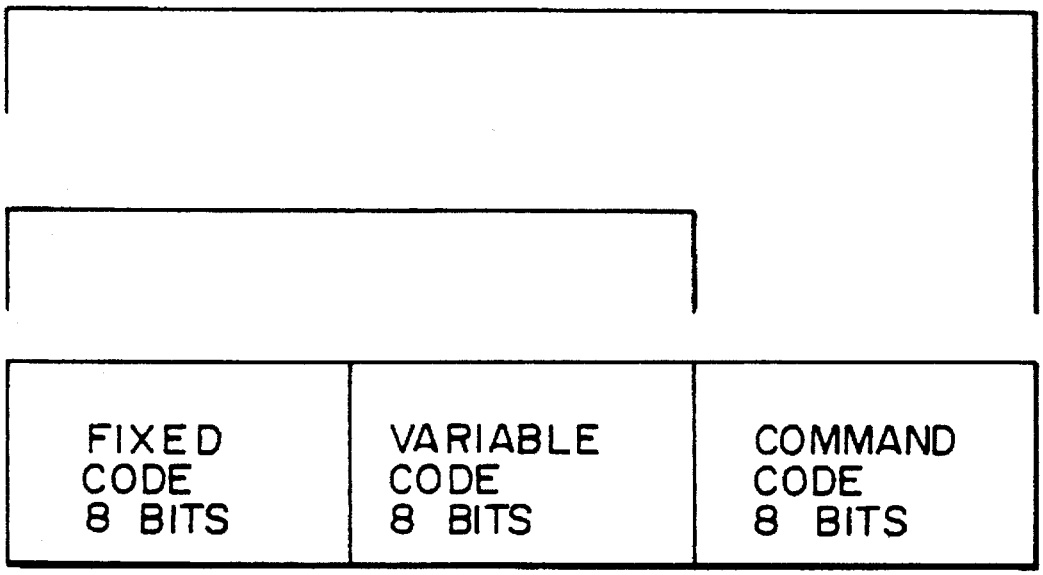
FIG. 2 is a diagram showing an example of a data structure transmitted from the transmitting unit.

FIG. 2 shows an example of the structure of the transmitted data. In this example, an 8-bit fixed code is set as a first block (field), an 8-bit variable code is set as a second block, and an 8-bit command code corresponding to one of the arming key 11, the disarming key 12 and the trunk unlock key 17 is added as a third block at the time of transmission.

FIG. 3 shows an example of setting of a variable code in the transmitting unit 1. In this example, at a first transmission time, when the arming key 11, the disarming key 12 or the trunk unlock key 17 of the transmitting unit 1 is depressed, a variable code e.g. (10110001) previously stored in the storage section 13*a* is transmitted. At a second transmission time, the code bits are shifted one place to the right, and O of a timing code described below is added as the most significant bit of the shifted code to form e.g. (01011000). Subsequently, this processing is repeated with respect to other transmission times. The variable code setting may be performed after each transmission time.

Figure 4:
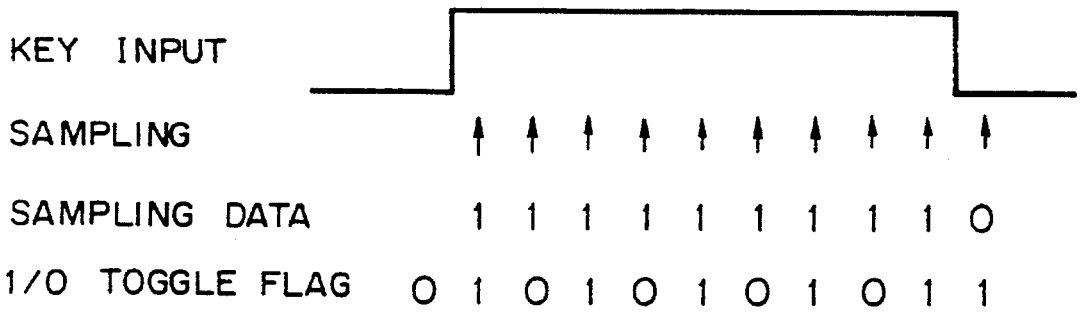
FIG. 4 is a diagram showing an example of setting a timing code added to the variable code in the transmitting unit.

FIG. 4 shows an example of setting of a timing code added to the variable code in the transmitting unit. When the arming key 11 or the disarming key 12, or the trunk unlock key 17 of the transmitting unit 1 is depressed, a key input changes from a low level to a high level. The key input becomes the low level again when the key is released from the depressed state. The key input during this key input period is sampled in predetermined cycles from the key depressing time. When the key input is high level, "1" is output as sampling data and, when the key input is low level, O is output. In correspondence with this sampling data, a 1/0 toggle flag is set. If the key is continuously maintained in its depressed state, the 1/0 toggle flag is inverted. That is, if the sampling data is "1" at a first sampling point, the initial value of the 1/0 toggle flag is inverted to "1". At a second sampling point, the key is still maintained in its depressed state and the "1" set at the first sampling point is therefore inverted to "O". At a tenth sampling point, since the key has been released from the depressed state, the sampling data is "O", the preceding value "1" of the 1/0 toggle flag "1" is maintained without being inverted. This value "1" of the toggle flag is set as a timing code.

A modulation circuit 14 (see FIG. 1) modulates a carrier wave having a predetermined frequency of a transmitting circuit 15 in accordance with predetermined data output from the controller 1. The transmitting circuit 15 generates the carrier wave of the predetermined frequency and modulation circuit 14 modules this carrier wave to form a modulated signal. The transmitting circuit 15 power amplifies the modulated signal and emits a radio wave of this signal from a loop antenna 16 connected to its output terminals.

A security receiving unit 2 is provided (1) which is enabled to accept the arming command signal from the transmitting unit 1 when the vehicle engine is stopped and when the doors are closed and, in this accepting state, starts a security operation and locks the doors in response to the arming command signal sent from the transmitting unit 1, (2) which stops the security operation and unlocks the doors when it receives the disarming command signal, (3) which performs a burglar proofing operation if the activity of a thief (a security breach) is detected during the security operation, and (4) which is enabled to accept the trunk unlock command signal from the transmitting unit 1 when the security operation is stopped (when a disarming mode is selected) and, in this accepting state, unlocks the trunk in response to the trunk unlock command signal sent from the transmitting unit 1.

The configuration of sections of the security receiving unit 2 is described below. The security receiving unit 2 has a receiving antenna 21 and a receiver 22 which receives and demodulates signals transmitted from the transmitting unit 1.

A security controller 23 starts the security operation and locks the doors in response to the arming command signal sent from the transmitting unit, stops the security operation and unlocks the doors in response to the disarming command signal, and performs a burglar proofing operation if the activity of a thief is detected during the security operation. Each of the arming command signal and the disarming command signal from the transmitting unit 1 contains an ID code which is determined by being compared with an ID code provided in the receiving unit 2. If it is determined that the ID codes coincide with each other as a result of the comparison, the receiving unit 1 becomes able to accept the signal, and starts or stop the security operation. It may also stop the burglar proofing operation.

In more detail, the security controller 23 has a storage section 23*a* for storing a fixed code and a variable code, a comparison/determination section 23*b* for determining a fixed code and a variable code by comparing these codes with the fixed code and the variable code stored in the storage section 23*a*, and an operation control section 23*c* for starting or stopping the predetermined security operation according to the content of received data if the fixed codes and predetermined portions of the variable codes coincide with each other-as a result of the comparison and determination effected by the comparison/determination section 23*b*. The security controller 23 also has a second code updating section 23*d* which, if the fixed codes and predetermined portions of the variable codes coincide with each other, shifts the variable code by a predetermined shift value, adds a predetermined code to the shifted variable code to form a new variable code, and replaces the preceding variable code with the new variable code. Also, if predetermined portions of the variable codes do not coincide with each other while the fixed codes coincide with each other, the second code updating section 23*d* shifts the variable code by the predetermined shift value, adds a predetermined code to the shifted variable code to form a new variable code, and replaces the preceding variable code with the new variable code.

It is to be understood that with reference to FIG. 1, in one embodiment each of controller 13 and security controller 23 are conventional microprocessors or microcontrollers (CPU's) with associated memory, each CPU being suitably programmed to carry out the functions described herein, by means of computer programs conventionally resident in controller 13 and security controller 23.

A detection section 3 detects opening and closing of the doors, vibration of the vehicle, and the opening and closing of the trunk. The detection section 3 has a door opening/closing sensor 31, a vibration detecting sensor 32, and a trunk opening/closing sensor 33. A burglar proofing unit 4 has a light driver 41 which turns on and off the vehicle head lamps by an on-off drive signal BLD output from the security controller 23 when an abnormality (e.g., door opening or closing, vehicle vibration, or trunk opening or closing) is detected by the corresponding sensor during the security operation, and a siren driver 42 which sounds a siren by a siren drive signal SDR in the same situation.

An engine control section 5 inhibits engine start by cutting off an engine starter circuit or fuel supplied to the engine by a signal ESP which is output from the security controller 23 when an abnormality is detected by one of the sensors during the security operation.

A door lock/unlock device 6 performs a door lock control to lock the doors by a signal DSP which is output from the security controller 23 when the arming command signal is received to set the arming mode. Also, the door lock/unlock device 6 performs a door unlock control to unlock the doors by a signal DSP which is output from the security controller 23 when the disarming command signal is received to set the disarming mode.

A trunk lock device 7 performs a trunk unlock control to unlock the trunk by a signal TSP which is output from the security controller 23 when the trunk unlock command signal is received during the disarming mode.

FIG. 5 is a diagram explaining a process of setting an ID code in the security system in accordance with the present invention. The process of setting an ID code in the transmitting unit 1 and an acceptable code in the security receiving unit 2 in the security system shown in FIG. 1 is described in detail with reference to FIG. 5.

First, when the arming key 11 or the disarming key 12 of the transmitting unit 1 is depressed by a user, the ID code setting section 13*c* of the controller 13 of the transmitting unit 1 fetches a fixed code (10101010) and a variable code (10110001) from the storage section 13*a* and sets an ID code consisting of the fixed code and the variable code.

Then, the controller 13 adds the command code corresponding to the depressed key to the variable code to prepare data to be transmitted, as described above with reference to FIG. 2, and transmits the data to the security receiving unit 2 through the modulation circuit 14, the transmitting circuit 15 and the loop antenna 16.

When the security controller 23 of the security receiving unit 2 receives the data transmitted from the transmitting unit 1 through the receiving antenna and the receiver 22, the comparison/determination section 23*b* of the security controller 23 fetches as acceptable codes a fixed code (10101010) and a variable code (* * * * * * * *) and determines the codes in the received transmitted data by comparing the received codes to the fetched codes. However, the comparison and the determination are not made at the first transmission time assuming that the two groups of codes coincide with each other. After reading the first-time variable code, the security controller 23 of the security receiving unit 2 shifts the variable code one place to the right and adds an arbitrary bit (0 or 1) as a most significant bit. The arbitrary bit is assumed as (*) here. The preceding variable code (* * * * * * * *) stored in the storage section 23*a* is replaced with the new variable code (*1011000). Subsequently, the same updating processing is repeated each time data is transmitted.

Transmitted data can be accepted if the ID code and the variable code fetched from the storage section 23*a* by the comparison/determination section 23*b* coincide with the ID code and the variable code of the transmitted data. However, bits of the variable codes other than the most significant bits are compared. That is, for example, with respect to the variable code (01011000) in the data transmitted from the transmitted unit 1 at the second time, 7 bits of the variable code, exclusive of the most significant bit (0), are compared with 7 bits (1011000) of the acceptable code (*1011000) of the security receiving unit 2 exclusive of the most significant bit (*).

Next, a case of occurrence of ineffective key pressing is described. For example, if ineffective key pressing occurs at the fourth, fifth and sixth transmission times, and ordinary transmission is effected at the seventh time, the variable code on the transmitting side becomes (01011010). On the other hand, the receiving unit is storing the variable code (*1011000) transmitted at the third time. Accordingly, 7 bits (1011010) of the variable code on the transmitting side and 7 bits (1010110) of the variable code on the receiving side are compared. Since these bits do not coincide with each other, the data is not accepted. However, since the fixed codes coincide with each other, the security controller 23 reads the received variable code, executes the above-described shift processing and stores (*0101101) in the storage section 23*a*.

When the key is again pressed to transmit the data (at the eighth transmission time), (00101101) is transmitted as the variable code on the transmitting side. Then, 7 bits (0101101) of the variable code on the transmitting side and 7 bits (0101101) on the receiving side are compared. Since they coincide with each other, the data can be accepted. That is, even if ineffective key pressing occurs many times, data can be accepted by transmission after performing an idle transmission once.

Some vehicles having a keyless entry system have a selective unlock function which unlocks only the door by the driver's seat when a door unlock signal is transmitted from a keyless entry system transmitting unit at a first time, and thereafter unlocks the other doors if the door unlock signal is again transmitted in three seconds after the first transmission time.

The security system of the invention can unlock the doors by being linked to the disarming command signal from the transmitting unit 1.

If the security system is provided for a vehicle having such a selective unlock function, it is natural that when the system is operated to unlock all the doors, the selective unlock function is activated so that all the doors cannot be unlocked unless the disarming command signal is transmitted two times. If in such a situation the disarming command signal is copied two times, the security system can be disarmed. Then, the system may alternatively be arranged so that unlocking is inhibited when the signal is transmitted two times, and is allowed when the signal is transmitted three times. The number of times at which unlocking is allowed may be set to any suitable number more than three according to one's need.

Figure 6:
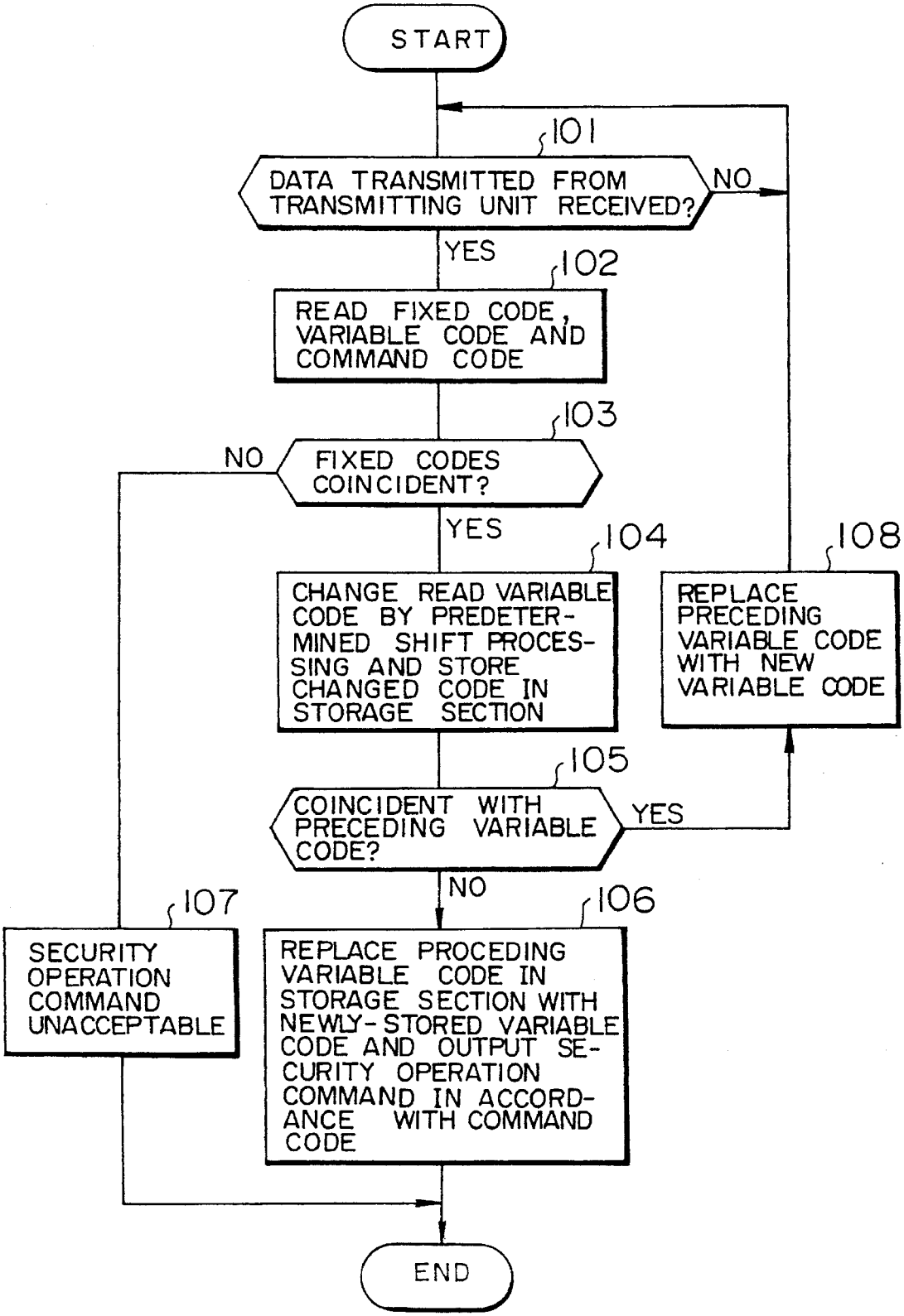
FIG. 6 is a flowchart of processing of the security controller in the receiving unit in accordance with the present invention.

FIG. 6 is a flowchart of processing of the security controller 23 in the security receiving unit 2 in accordance with the present invention. The operation of the security receiving unit 2 is described with reference to this flowchart.

First, if, for example, a user has depressed the arming key 11 or the disarming key 12 of the transmitting unit 1, transmitted data is transmitted from the transmitting unit 1 and is received by the security controller 23 of the security receiving unit 2 through the receiving antenna 21 and the receiver 22 (step 101), the comparison/determination section **23*b* of the security controller 23 reads the fixed ID code, the variable code and the command code in the transmitted data (step 102**).

The comparison/determination section **23*b* then compares the read fixed code and the fixed code stored in the storage section 23*a* to determine whether these codes coincide with each other (step 103). If these codes coincide with each other, the read variable code undergoes the predetermined shift processing and is stored in the storage section 23*a* (step 104). Next, predetermined portions of the preceding variable code and the received variable codes are compared (step 105). If they coincide with each other, the preceding variable code in the storage section 23*a* is replaced with the variable code changed by shift processing and newly stored, and a security operation command is output according to the command code (step 106**).

If the fixed code in the transmitted data and the fixed code stored in the storage section **23*a* do not coincide with each other in step 103, no security operation command is accepted (step 107**).

If the variable code in the transmitted data and the variable code changed by shift processing and stored in the storage section **23*a* do not coincide with each other in step 105, the preceding variable code is replaced with the new variable code (step 108), and the process returns to step 101** to subsequently perform the same processing.

Thus, the ID code is changed each time data is transmitted. Therefore, a thief cannot disarm the security system even if he or she has succeeded in copying the transmitted data signal with a copying device.

The embodiment has been described with respect to a vehicle security system, but the present invention can also be applied to a home security system, a keyless entry system and the like. Transmission and reception of data may be performed using an optical transmission medium, a wire medium or the like as well as a radio transmission medium.

In the above-described embodiment, the fixed code and the variable code are 8-bit codes. However, these codes may be of any number of bits.

The arrangement of the security system in accordance with the present invention may alternatively be such that one key capable of serving both as the arming key 11 and the disarming key 12 of the transmitting unit 1 is used and door locking and unlocking are alternately performed with respect to reception times.

If a key serving both as the arming key 11 and the disarming key 12 is used, the need for a command code in the transmitted signals is eliminated and the transmission time can be reduced correspondingly. However, a command code is required in a trunk unlock command signal.

If the detection section 3, the burglar proofing unit 4, the engine control section 5 and the trunk unlock device 7 are removed from the security receiving unit 2, the entire system is arranged as a keyless entry system for performing only door locking and unlocking. In such a system, signals transmitted from the transmitting unit 1 may be formed only of a fixed code and a variable code without using any command code.

According to the present invention, in the transmitting unit, each time data is transmitted, a variable code stored in the storage section is shifted by a predetermined shift value, a predetermined code is added to the shifted variable code according to a transmission timing to form a new variable code, and the preceding variable code is replaced with the new variable code. An ID code formed of the variable code and a fixed code stored in the storage section is then set in the storage section, and predetermined data including the set ID code is transmitted to the security receiving unit. In the security receiving unit, when the predetermined data from the transmitting unit is received, the fixed code and the variable code in the ID code of the received data are compared with a fixed code and a variable code stored in the storage section, a security operation is started or stopped according to a content of the received data if it is determined by this comparison that the fixed codes and predetermined portions of the variable codes coincide with each other. Also, the received variable code is shifted by the predetermined shift value, a predetermined code is added to the shifted bits to form a new variable code, and the preceding code is replaced with the new variable code. It is therefore impossible wrongly to produce a transmitting unit identifiable as the genuine transmitting unit even by using a copying device such as a learning remote controller to copy the transmitted data during disarming.

Also, if the fixed codes coincide with each other while the predetermined portions of the variable code do not coincide with each other, the received variable code is shifted by the predetermined shift value, a predetermined code is added to the shifted bits to form a new variable code, and the preceding code is replaced with the new variable code. Therefore, if normal transmitted data is next received, it can be accepted. That is, even after ineffective key pressing has been repeated a number of times, the ordinary remote control operation can be restored by performing an idle transmission only one time, thereby limiting the occurrence of ineffective key pressing.

What is claimed is:

1. A remote-controlled apparatus comprising a transmitting unit and a receiving unit, predetermined data being transmitted from said transmitting unit to said receiving unit, said transmitting unit including:

a first code updating section for updating a first ID code; and a data transmitting section for transmitting predetermined data including the updated first ID code to said receiving unit;

said receiving unit including:

a data receiving section for receiving the predetermined data from said transmitting unit;

a code comparison section for comparing the first ID code with a second ID code stored in the receiving unit;

an operation control section for starting or stopping a predetermined operation according to a content of the received predetermined data when a coincidence occurs between the first ID code of the predetermined data and the stored second ID code as a result of the comparison made by said code comparison section; and a second code updating section for replacing the second ID code with the received first ID code in a predetermined manner to update the second ID code when a coincidence occurs between the first ID code and the second ID code;

wherein the first ID code comprises a variable code including a series of bits, and wherein the first code updating section of said transmitting unit shifts values associated with each of the series of bits of the variable code stored in the transmitting unit by a predetermined shift value while replacing one bit with a predetermined value according to a transmission timing to form an updated variable code.

2. A remote-controlled apparatus according to claim 1, wherein said predetermined data includes the first ID code and a command code.

3. A remote-controlled apparatus according to claim 1, wherein said first ID code further includes a fixed code.

4. A remote-controlled apparatus according to claim 1, wherein each of said transmitting unit and said receiving unit includes a memory for respectively storing the first ID code and the second ID code.

5. A remote-controlled apparatus according to claim 1, wherein said series of bits includes a most significant bit and a least significant bit, and wherein the values associated with the series of bits of the variable code are shifted from the most significant bit to the least significant bit, and wherein the most significant bit is updated with the predetermined value.

6. A remote-controlled apparatus according to claim 3, wherein said code comparison section of said receiving unit compares the fixed code of the first ID code with a stored fixed code of the second ID code, and compares the variable code of the first ID code with a stored variable code of the second ID code.

7. A remote-controlled apparatus according to claim 1, wherein said receiving unit comprises a security receiving unit, said remote-controlled apparatus comprises a security apparatus, and said predetermined operation comprises a security operation.

8. A remote-controlled apparatus comprising a transmitting unit and a receiving unit, predetermined data being transmitted from said transmitting unit to said receiving unit, said transmitting unit including a first memory for storing a first fixed code and a first variable code, the first variable code including a series of bits, said receiving unit including a second memory for storing a second fixed code and a second variable code, the second variable code including a series of bits, said transmitting unit including:

a first code updating section for updating the first variable code stored in the transmitting unit by shifting values associated with each bit of the series of bits by a predetermined shift value while replacing a first bit the first variable code with a first predetermined value according to a transmission timing to form an updated first variable code, and storing the updated first variable code in the first memory; and a data transmitting section for transmitting predetermined data including the first fixed code and the updated first variable code to said receiving unit;

said receiving unit including:

a data receiving section for receiving the predetermined data from said transmitting unit;

a code comparison section for comparing the first fixed code with the second fixed code and for comparing the first variable code with the second variable code stored in said transmitting unit;

an operation control section for starting or stopping a predetermined operation according to a content of the received predetermined data when the first and second fixed codes and predetermined portions of the first and second variable codes coincide with each other as a result of the comparison made by said code comparison section; and a second code updating section for updating the second variable code by shifting the values associated with each bit of the first variable code by the predetermined shift value while updating a first bit of the first variable code with a second predetermined value to form an updated second variable code, and storing the updated second variable code in the second memory when the first and second fixed codes and the predetermined portions of the first and second variable codes coincide with each other.

9. A remote-controlled apparatus according to claim 8, wherein, in said second code updating section, when the first and second fixed codes coincide with each other while the predetermined portions of the first and second variable codes do not coincide with each other, the received first variable code is shifted by the predetermined shift value while updating the first bit of the second variable code with a second predetermined value to form a second updated second variable code, and replacing the second variable code stored in the second memory with the second updated second variable code.

10. A remote-controlled apparatus according to claim 8, wherein the each of the first and second variable codes include a most significant bit and a least significant bit, and wherein values associated with each of the first and second variable codes are respectively shifted from the most significant bit to the least significant bit, and wherein the most significant bits of the first and second variable codes are respectively updated with the first and second predetermined values.

11. A remote-controlled apparatus according to claim 8, wherein one of said first and second predetermined values comprises an arbitrary value added to a most significant bit of one of the shifted first and second variable coded.

12. A remote-controlled apparatus according to claim 8, wherein one of said first and second predetermined values comprises sampling data obtained by sampling in predetermined cycles from a moment at which a key of said transmitting unit is depressed to a moment at which the key is released from the depressed state, said sampling data being obtained at the moment at which the key is released from the depressed state.

13. A remote-controlled apparatus according to claim 8, wherein the portions of the first and second variable codes compared by the code comparison means excludes respective most significant bits associated with each of the first and second variable codes.

14. A remote-controlled apparatus according to claim 8, wherein the content of the received predetermined data includes a command code.

15. A remote-controlled apparatus according to claim 8, wherein said receiving unit comprises a security receiving unit, said remote-controlled apparatus comprises a security apparatus, and said predetermined operation comprises a security operation.

16. A data transmission method which transmits predetermined data from a transmitting unit to a receiving unit, said transmitting unit including a first memory for storing a first fixed code and a first variable code, the first variable code including a series of bits, said receiving unit including a second memory for storing a second fixed code and a second variable code, the second variable code including a series of bits, the method comprising the steps of:

in the transmitting unit, shifting values associated with the first variable code by a predetermined shift value while replacing a first bit of the first variable code with a predetermined value to form an updated first variable code, storing the updated first variable code in the first memory, setting an ID code containing the updated first variable code and the first fixed code, and transmitting predetermined data including the set ID code to the receiving unit; and in said receiving unit, receiving the predetermined data from the transmitting unit, comparing the first fixed code and the first variable code in the ID code with the second fixed code and the second variable code, and when the first and second fixed codes and predetermined portions of the first and second variable codes coincide with each other as a result of the comparison, performing a predetermined operation according to a content of the received predetermined data, updating the second variable code by shifting the values associated with each bit of the received first variable code by the predetermined shift value while updating the first bit with a predetermined value to the form an updated second variable code, and storing the updated second variable code in the second memory.

17. A data transmission method according to claim 16, wherein in said step of comparing the first and second fixed codes and the first and second variable codes, when the first and second fixed codes coincide with each other while the predetermined portions of the first and second variable codes do not coincide with each other, then in the subsequent step of updating the second variable code with the updated second variable code, the received first variable code is shifted by the predetermined shift value, the first bit is updated by the second predetermined value to form a second updated second variable code, and the second variable code stored in the second memory is replaced with the second updated second variable code.

18. A data transmission method according to claim 16, wherein the first and second variable codes in the transmitter and in the receiver are shifted in a direction from a most significant bit to a least significant bit.

19. A data transmission method according to claim 16, wherein one of the first and second predetermined values comprises an arbitrary value added to a most significant bit of the shifted first and second variable codes.

20. A remote controller transmitting unit for transmitting predetermined data to a receiving unit, said transmitting unit comprising:

a memory for storing a code;

a code updater connected to said memory, whereby said code updater shifts the code stored in said memory by a predetermined shift value and replaces one bit of the code with a randomly generated value;

a code setter connected to said memory, whereby said code setter sets the predetermined data as including the code stored in said memory; and a transmitting circuit connected to said code setter, for transmitting the predetermined data.

21. A method for transmitting predetermined data from a transmitting unit to a receiving unit, comprising the steps of:

storing a code in said transmitting unit;

updating said code stored in said transmitting unit by shifting said code by a predetermined shift value and replacing a bit of the code with a randomly generated value;

combining the updated code with command data; and transmitting the combined updated code and said command data to said receiving unit.

* * * * *